US005638052A

United States Patent [19]

Furuya et al.

[11] Patent Number: 5,638,052

[45] Date of Patent: Jun. 10, 1997

[54] LED MATRIX DISPLAY WITH LED CONTROL SWITCHES ADJACENT TO EACH LED

[75] Inventors: Etsuo Furuya; Kiyoshi Yamashita; Yoshiaki Hayashi, all of Shizuoka, Japan

[73] Assignee: Koito Manufacturing Co., Ltd., Tokyo, Japan

[21] Appl. No.: 281,073

[22] Filed: Jul. 27, 1994

[30] Foreign Application Priority Data

Jul. 30, 1993 [JP] Japan ..... 5-045901 U

[51] Int. Cl.[6] ..... G09G 3/22

[52] U.S. Cl. ..... 340/815.45; 345/82

[58] Field of Search ..... 340/815.45, 815.47, 340/815.48, 815.73, 815.74, 815.75; 345/44, 46, 48, 51, 59, 82, 84, 173, 175; 341/22; 200/317; 40/573; 446/219

[56] References Cited

U.S. PATENT DOCUMENTS

| | | | |
|---|---|---|---|
| 3,732,389 | 5/1973 | Kaelin et al. | 341/22 |
| 3,777,222 | 12/1973 | Harris | 200/317 |
| 3,940,756 | 2/1976 | Findlay | 345/82 |
| 4,035,939 | 7/1977 | Dadian | 40/573 |
| 4,196,539 | 4/1980 | Speers | 446/219 |
| 4,271,408 | 6/1981 | Teshima et al. | 340/815.45 |
| 4,298,869 | 11/1981 | Okuno | 345/82 |
| 4,383,254 | 5/1983 | Gemmell et al. | 340/815.45 |
| 4,445,132 | 4/1984 | Ichikawa et al. | 340/815.45 |
| 4,485,377 | 11/1984 | Claus et al. | 345/82 |
| 4,929,936 | 5/1990 | Friedman et al. | 340/815.45 |
| 5,186,531 | 2/1993 | Ryder et al. | 362/66 |
| 5,319,529 | 6/1994 | Lukkarinen et al. | 362/66 |

FOREIGN PATENT DOCUMENTS

| | | | |
|---|---|---|---|
| 4216275 | 8/1993 | Germany | F21M 3/20 |
| 4210211 | 9/1993 | Germany | F21M 3/20 |
| 2201023 | 8/1988 | United Kingdom | G09F 13/00 |

*Primary Examiner*—Richard Hjerpe
*Assistant Examiner*—Paul Bell
*Attorney, Agent, or Firm*—Sughrue, Mion, Zinn, Macpeak & Seas

[57] ABSTRACT

A number of LEDs 6 are vertically and horizontally arrayed on a printed circuit board 5, thereby forming a display surface. Switches 7 for turning on or off the LEDs 6 and keeping them in an on or off state are provided at locations corresponding to or close to the LEDs 6. With this construction, the LEDs 6 can be turned on or off directly from the display surface.

26 Claims, 5 Drawing Sheets

LED MATRIX DISPLAY WITH LED CONTROL SWITCHES ADJACENT TO EACH LED

BACKGROUND OF THE INVENTION

The present invention relates to an information transfer technique for visually presenting various types of desired information in an alterable manner, and more particularly to a display device in which the input operation for altering the display contents is direct, simple and easy.

There has been known a device for visual information display in which a number of LEDs are arrayed on a board and in which some of these LEDs are turned on to visually present characters or figures. In the conventional display device of this type, the LEDs are set to be in an ON state or an OFF state by manually operating switches arrayed on the reverse side of a substrate or arrayed on a keyboard which is provided separately from the substrate. In other words, the setting of the LEDs is indirectly carried out. Accordingly, it is difficult to precisely set the LEDs for configuring characters, symbols, figures or the like. Thus, the LED setting operation for forming desired patterns in the conventional display device is deficient. Further, the structure of the conventional display device is complicated.

SUMMARY OF THE INVENTION

The present invention was made in view of the foregoing difficulties accompanying the conventional display device. Accordingly, an object of the present invention is to provide a display device for transferring visual information in which that the manual operation for altering the display contents is direct, simple, easy, and reliable.

The above and other objects can be achieved by providing a display device in which a number of LEDs are arrayed on a circuit board or substrate so that some of these LEDs can be turned on to visually present characters or figures. According to the invention, switches for turning on or off the LEDs are provided at locations adjacent to the associated LEDs.

Accordingly, setting the LEDs can be directly carried out on the display surface. The LED can be directly turned on or off. The input operation for altering the display is simple and reliable. As a result, the display of visual information can be altered in a very easy manner.

DESCRIPTION OF THE PREFERRED EMBODIMENTS

Figure 1:
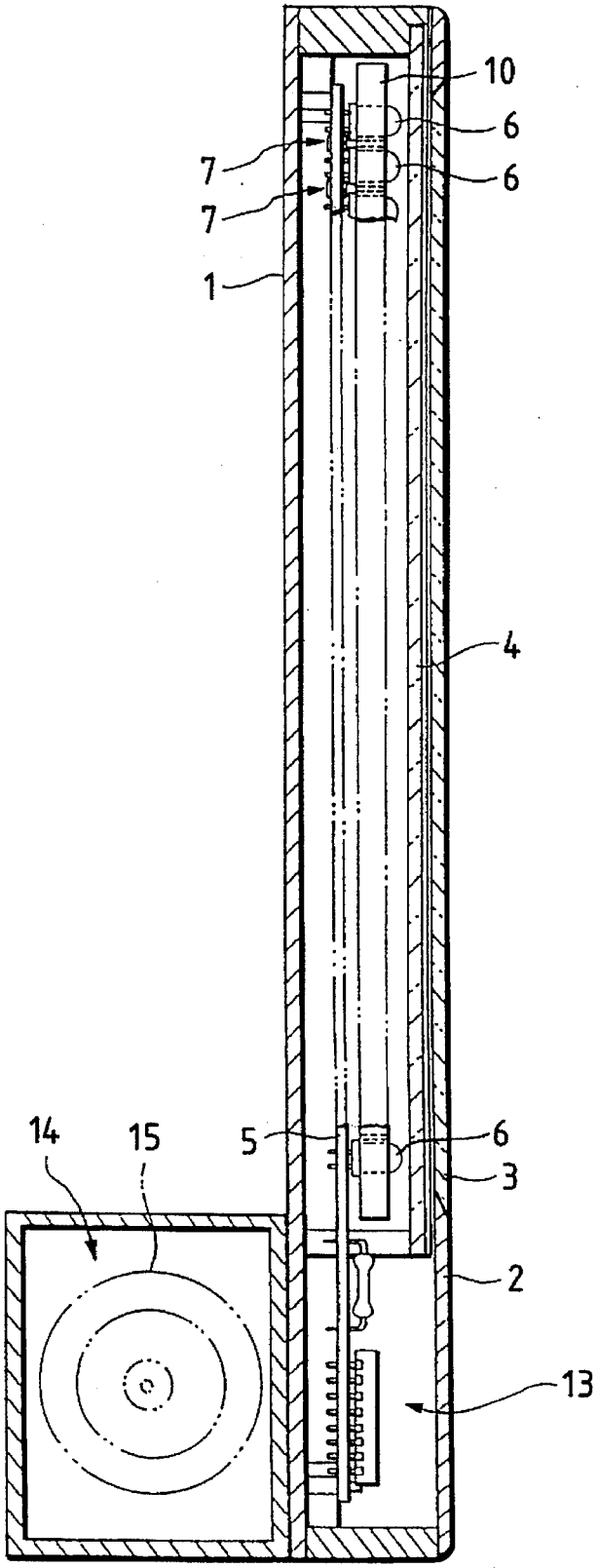
FIG. 1 is a side view showing a display device according to a first embodiment of the present invention.
Figure 2:
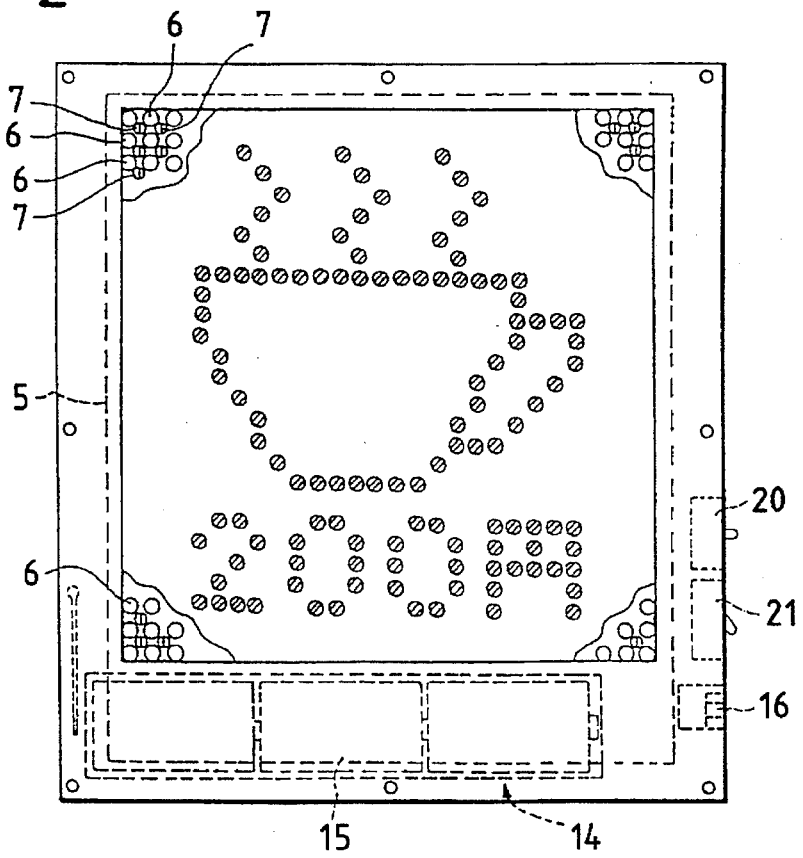
FIG. 2 is a front view, partly cut away, showing a state of display on the display device of FIG. 1.

The preferred embodiments of a display device according to the present invention will now be described with reference to the accompanying drawings. The nature, principle, and utility of the invention will be more clearly understood from the following detailed description of the invention when read in conjunction with the accompanying drawings.

FIGS. 1 through 4 show a first embodiment of the present invention. As shown in these figures, a switch associated with each LED is constructed of a membrane switch and a hold circuit. The display device is provided with a flat case frame 1 covered with a front plate 2 having a display window 3, and a display cover plate 4 formed of a transparent material such as acryl resin and mounted in the display window 3.

A printed circuit board 5 is supported within a case. A number of high-brightness LEDs (light emitting diodes) 6 are arrayed in a matrix fashion in an area on the printed circuit board 5, which is located facing the display window 3. Switches 7 for turning on and off the LEDs 6 are each located between the adjacent LEDs 6. Each switch 7 consists of a membrane switch 8 provided on the front side of the printed circuit board 5 and a hold circuit 9 actuated by the associated membrane switch 8 to switch between an "ON" state and an "OFF" state, or vice versa, and to maintain the state to which it has been switched.

The display device further includes a spacer 10, fastened to the front side of the printed circuit board 5, for separately defining the LEDs 6. The spacer 10 has a number of LED insertion holes 11 formed therein and arrayed at distances equal to these of the array of the LEDs 6, and a number of small holes 12 formed therein and located at positions corresponding to the membrane switches 8. The spacer 10, made of opaque material, functions as a shade for optically isolating the LEDs 6 from each other.

An LED control circuit 13 is mounted on the lower end of the printed circuit board 5. The LED control circuit 13 is driven by a battery 15 housed in a battery container 14 provided on the rear side of the case frame 1 or by an external DC power source supplied through an external power source terminal 16. A power select switch 20, when operated, selects either of these power sources, and also turns on and off the selected power source.

The LED control circuit 13 is constructed with an IC and constituted by a repeat circuit 17, a chopper circuit 18 for driving the repeat circuit 17 at preset intervals, and a flashing circuit 19 for causing a instantaneous lighting. In the repeat circuit 17, hold circuits 9, which are provided in association with the membrane switches 8, hold all of the LEDs 6 in an operating state. A display mode select switch 21 selects any one of "continuous lighting on", "flashing", and "instantaneous lighting" as a display mode.

Figure 3:
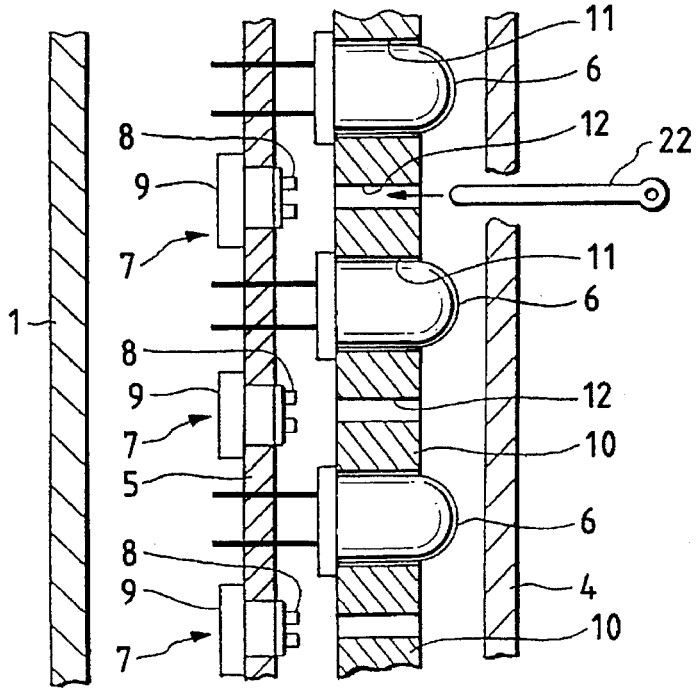
FIG. 3 is an enlarged view showing a key portion of the display device of FIG. 1.
Figure 4:
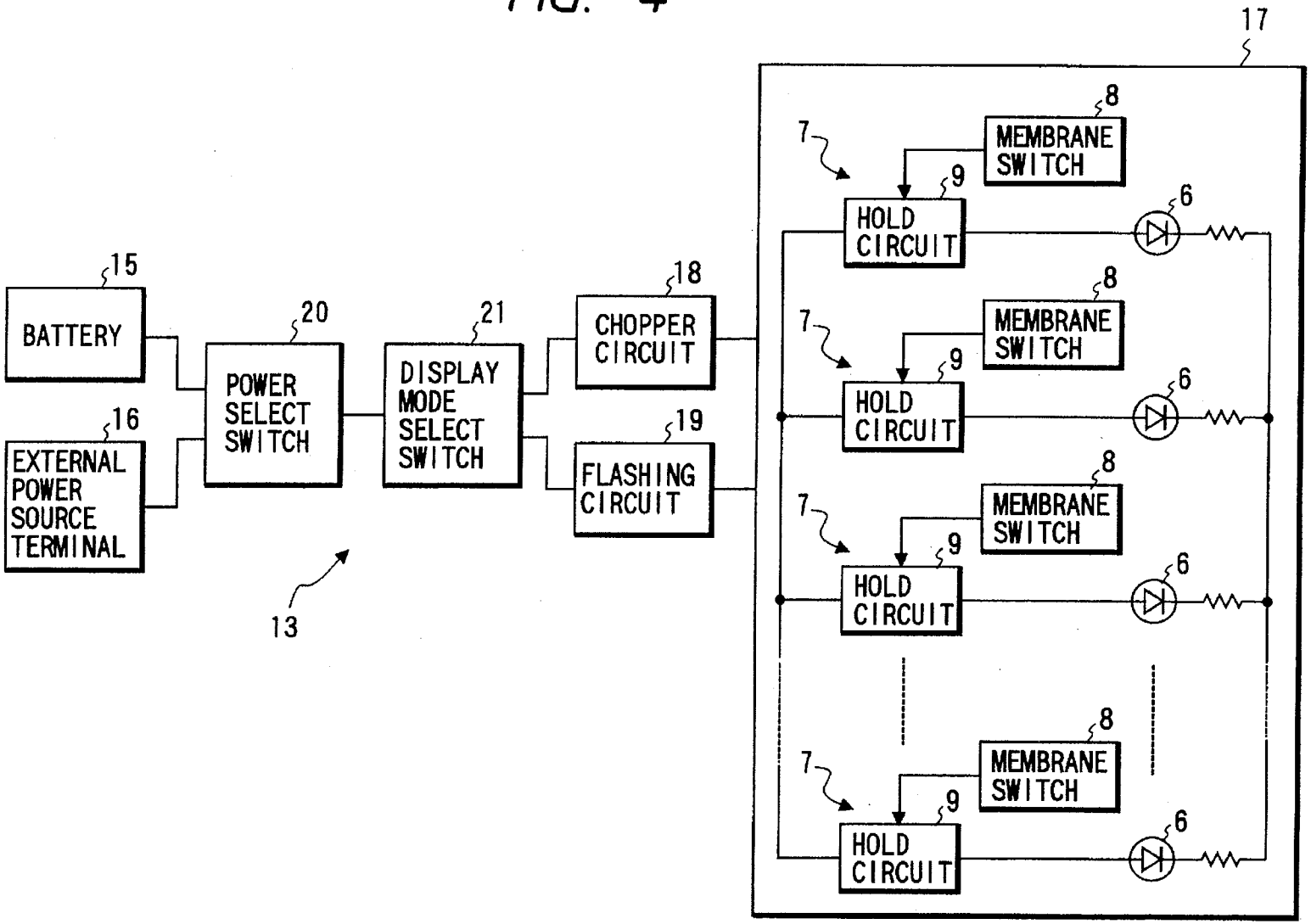
FIG. 4 is a block diagram showing an electric circuit of the display device.

As shown in FIG. 3, a switch drive needle-like jig 22 is inserted into each small hole 12 formed on the spacer 10, to actuate the related membrane switch 8 of the switch 7.

To set characters, symbols or patterns in the display device thus constructed, the power select switch 20 is turned on with the front plate 2 and the display cover plate 4 removed. The switch drive jig 22 is inserted into the small hole 12 formed in the spacer 10 to short circuit both electrodes of the membrane switches 8. With the short circuiting of the electrodes, the LED 6 associated with the switch 7 is turned on or off. The process is successively carried out for the LEDs used for displaying a desired pattern. The flashing of all the LEDs thus set up provides a display of the desired pattern.

The display mode select switch 21 is operated to select any one of two display modes having a, "continuous lighting on" condition with, "flashing", and "instantaneous lighting". The repeat circuit 17 keeps the display mode selected. To alter or modify the display, the switch drive needle-like jig 22 is inserted again into the small holes 12 of the switches 7, which are associated with the LEDs 6 to be altered or modified, to short circuit both electrodes of the membrane switches 8 associated therewith. As a result, the operating states of the switches 7 are inverted to turn on or off the LEDs 6.

Figure 5:
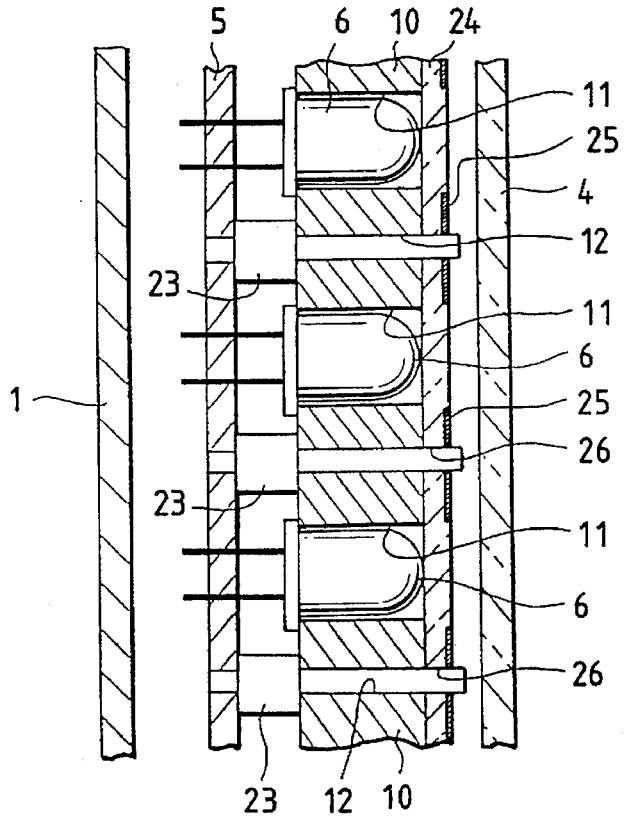
FIG. 5 is an enlarged view showing a key portion of a display device according to a second embodiment of the present invention.
Figure 6:
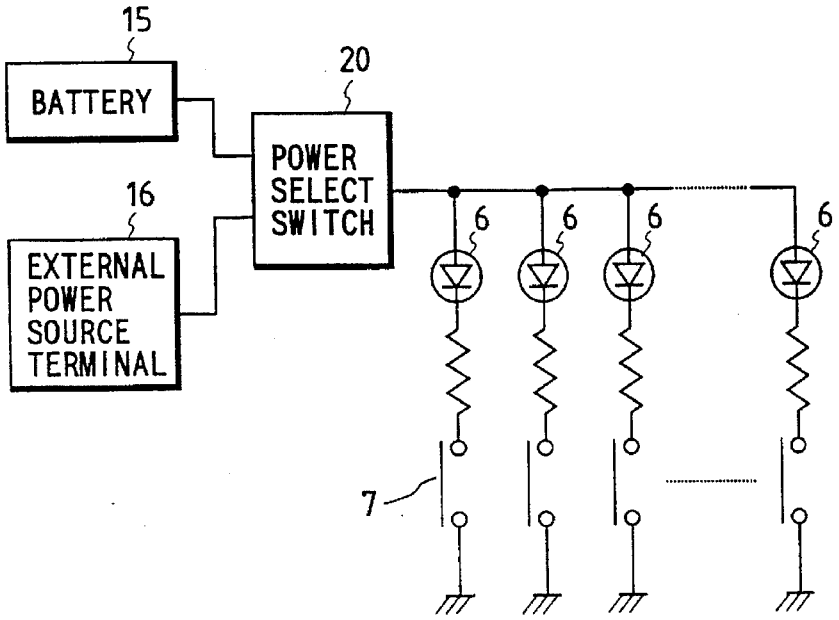
FIG. 6 is a block diagram showing an electric circuit of the display device of FIG. 5.

FIGS. 5 and 6 cooperate to show a second embodiment of the present invention. In the second embodiment, the switch 7 is mechanically turned on or off.

In the second embodiment, the switches associated with the LEDs 6 are constructed with known micro-hold-switches 23, which are extremely thin. By pushing the top of each switch, the terminals of a switch circuit formed on the base thereof are set in a closed or open state. A top of each of the micro-hold-switches 23 slightly protrudes from the front faces of the small holes 12 of the spacer 10. In the circuit construction, the micro-hold-switches 23 connect in series with the LEDs 6 associated therewith, respectively.

Reference numeral 24 designates a light diffusion sheet covering the spacer 10 for diffusing beams of light emitted from the LEDs 6, thereby improving visual recognition performance. Portions of the light diffusion sheet not located corresponding to the LEDs 6 are coated with light shielding films 25 colored black, for example. The light diffusion sheet further includes small holes 26 in locations corresponding to the small holes 12. A top of each of the micro-hold-switches 23 slightly protrudes through the small holes 26.

Figure 7:
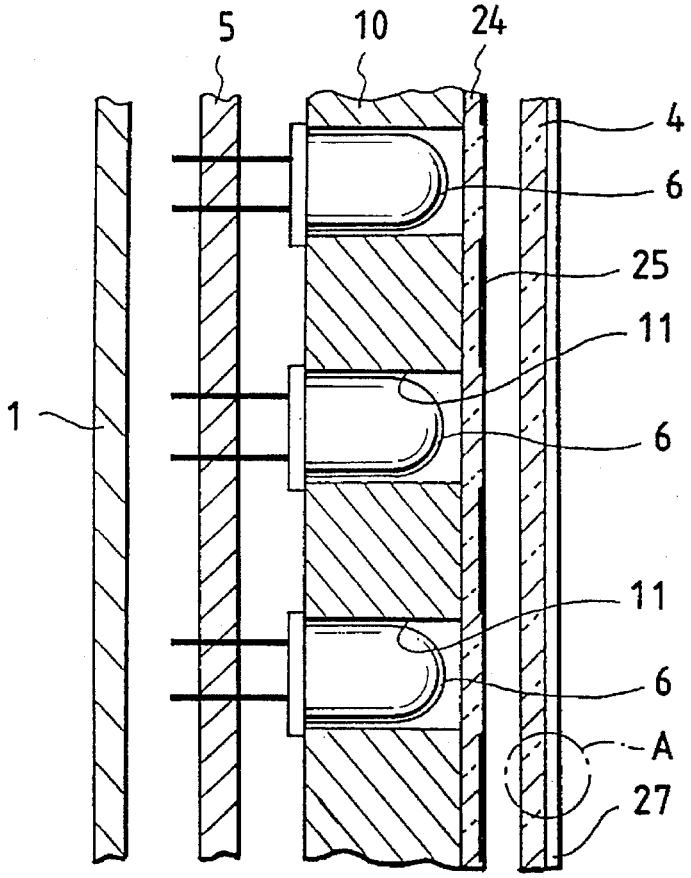
FIG. 7 is an enlarged view showing a key portion of a display device according to a third embodiment of the present invention.
Figure 8:
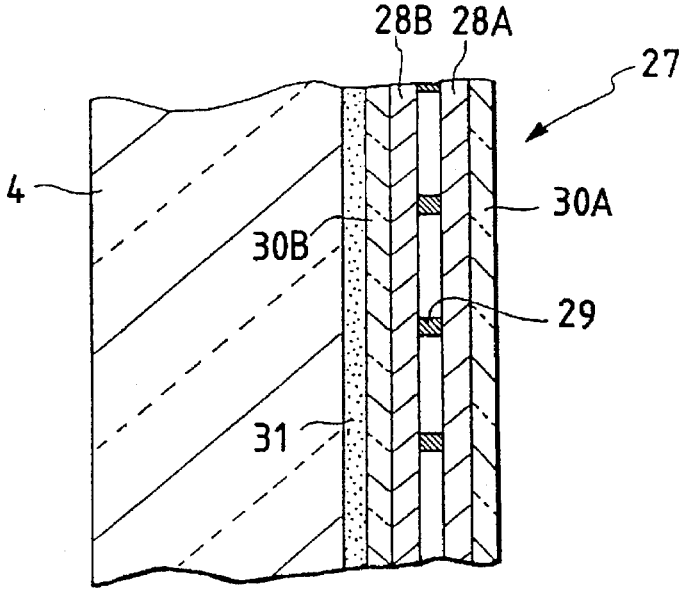
FIG. 8 is an enlarged view showing a portion A in FIG. 7.

FIGS. 7 and 8 show a third embodiment of the present invention. In the third embodiment, a transparent matrix switch sheet 27, which is bonded over a display cover plate 4 made of transparent material such as acrylate resin, is used for the switches. In the structure of the matrix switch sheet 27, as shown in FIG. 8, insulating layers 29 are inserted between upper and lower electrodes 28A and 28B, thereby forming a matrix array of contacts located corresponding to a matrix array of LEDs 6. The upper and lower surfaces of both the electrodes 28A and 28B are coated with transparent films 30A and 30B, respectively. The contacts of the matrix switch sheet 27 are connected to the hold circuit 9 already described in the first embodiment. When the positions on the matrix switch sheet 27, corresponding to the desired LEDs 6 are pushed, the LEDs are in a "light-on" or a "light-off" state. Reference numeral 31 depicts a bonding layer, such as a double-coated tape or adhesive, for attaching the matrix switch sheet 27 onto the display cover plate 4.

While preferred embodiments of the invention have been described, it will be obvious to those skilled in the art that various changes and modifications may be made thereto without departing from the invention, and it is aimed, therefore, to cover in the appended claims all such changes and modifications as fall within the true spirit and scope of the invention.

As seen from the foregoing description, in the display device of the invention, a number of switches are provided in association with a number of LEDs arrayed vertically and horizontally. These switches are provided at locations corresponding to or close to the LEDs. With this construction, the LEDs can be turned on or off directly from the display surface. The manual operation for altering the display is direct and easy. Therefore, the display contents of visual information can be changed, altered or modified in a direct and simple manner. It is believed that the effects of the present invention greatly contribute to the related field.

What is claimed is:

1. A display device comprising;

a power source;

a circuit board;

a first plurality of LEDs arrayed on said circuit board for visually presenting characters or figures when a second plurality of said first plurality of LEDs are energized;

a third plurality of switches, each of which actuates a corresponding one of said first plurality of LEDs, each of said switches being disposed at a location adjacent to said corresponding one of said first plurality of LEDs; a spacer secured to a front side of said circuit board, said spacer having formed thereon a fourth plurality of LED insertion holes arrayed at distances equal to those of the array of said first plurality of LEDs, and a fifth plurality of small holes, each of said small holes located corresponding to a respective one of said switches for activation thereof.

2. The display device according to claim 1, further comprising a housing for accommodating said circuit board.

3. The display device according to claim 2, wherein said housing comprises:

a flat case frame;

a front plate covering said flat case frame, said front plate having a display window; and a display cover plate mounted inside said display window.

4. The display device according to claim 3, wherein said display cover plate is formed of a transparent material.

5. The display device according to claim 4, wherein said display cover plate is formed of acrylate resin.

6. The display device according to claim 1, wherein said first plurality of LEDs are of high-brightness type and are arrayed in a matrix pattern in an area on said circuit board.

7. The display device according to claim 1, wherein a switch drive needle-like jig is selectably inserted into said fifth plurality of small holes for selective actuation of said switches.

8. The display device according to claim 7, wherein said spacer is formed of opaque material.

9. The display device according to claim 1, wherein said power source is a battery.

10. The display device according to claim 9, further comprising a housing and a battery container attached to a rear side of said housing, said battery container for housing said battery.

11. The display device according to claim 1, further comprising an external power source terminal.

12. The display device according to claim 11, wherein said power source is an external DC power source supplied through said external power source terminal.

13. The display device according to claim 1, wherein said power source is one of a battery and an external DC power source, further comprising a power select switch for selecting one of said battery and said external DC power source and for turning on and off the selected power source.

14. The display device according to claim 1, wherein each of said switches comprises:

a membrane switch disposed on a front side of said circuit board; and a hold circuit actuated by said membrane switch which switches from an "ON" state to an "OFF" state when said hold circuit is in an "ON" state immediately preceding actuation, and which switches from an "OFF" state to an "ON" state when said hold circuit is in an "OFF" state immediately preceding actuation, and said hold circuit holds the state to which it has been switched.

15. The display device according to claim 1, wherein said control circuit comprises:

a repeat circuit having a fourth plurality of hold circuits, wherein each of said hold circuits is provided in association with one of said switches and holds the LED corresponding to said one of said switches in an operating state;

a chopper circuit for driving said repeat circuit at preset intervals; and a flashing circuit connected in parallel with said chopper circuit for causing a flashing at preset intervals.

16. The display device according to claim 15, wherein said control circuit is constructed with an IC.

17. The display device according to claim 15, wherein said control circuit further comprises a display mode select switch connected to said chopper circuit and said flashing circuit.

18. The display device according to claim 17, wherein said display mode select switch selects from among the display modes of, "continuous lighting on", combined with either "flashing" and "instantaneous lighting".

19. The display device according to claim 1, wherein each of said switches comprises an extremely thin micro-hold-switch having a top which protrudes slightly from a front face of a respective one of said fifth plurality of small holes of said spacer, and said micro-hold-switch connects in series with said LED associated therewith.

20. The display device according to claim 7, further comprising a light diffusion sheet covering said spacer 10 for diffusing beams of light emitted from said LEDs, wherein portions of said light diffusion sheet which are not located at positions corresponding to said first plurality of LEDs are coated with light shielding films.

21. The display device according to claim 20, wherein said light shielding films are colored black.

22. The display device according to claim 3, further comprising a transparent matrix switch sheet attached over said display cover plate.

23. The display device according to claim 22, wherein said matrix switch sheet comprises:

an upper electrode;

a lower electrode;

a plurality of insulating layers inserted between said upper and lower electrodes;

an upper and a lower transparent film coating said upper and lower electrodes, respectively.

24. The display device according to claim 23, further comprising a bonding layer disposed between said matrix switch sheet and said display cover plate for attaching said matrix switch sheet and said display cover plate to each other.

25. The display device according to claim 24, wherein said bonding layer is a double-coated tape.

26. The display device according to claim 24, wherein said bonding layer is an adhesive.

* * * * *